US012668413B2

(12) United States Patent
Bruce et al.

(10) Patent No.: US 12,668,413 B2
(45) Date of Patent: Jun. 30, 2026

(54) STORAGE SYSTEM FOR PERISHABLE ITEMS

(71) Applicant: Pizza Pouch, LLC, Vancouver, WA (US)

(72) Inventors: Kelly Bruce, Vancouver, WA (US); Sloan Kimball, Vancouver, WA (US)

( * ) Notice: Subject to any disclaimer, the term of this patent is extended or adjusted under 35 U.S.C. 154(b) by 349 days.

(21) Appl. No.: 18/197,000

(22) Filed: May 12, 2023

(65) Prior Publication Data

US 2024/0375850 A1 Nov. 14, 2024

(51) Int. Cl.
*B65D 83/08* (2006.01)
*B65D 33/02* (2006.01)
*B65D 33/25* (2006.01)

(52) U.S. Cl.
CPC ..... *B65D 83/0835* (2013.01); *B65D 33/02* (2013.01); *B65D 33/2508* (2013.01)

(58) Field of Classification Search
CPC ..... B65D 83/08325; B65D 33/02; B65D 33/2508
USPC ..... 221/176
See application file for complete search history.

(56) References Cited

U.S. PATENT DOCUMENTS 2,345,309 A * 3/1944 Wensel, Jr. ..... B65D 83/0888 221/102
2,906,478 A * 9/1959 Merrick ..... B65B 67/1227 248/95
3,089,586 A * 5/1963 Cole ..... B65D 83/0888 221/45
3,197,062 A * 7/1965 Day ..... B65D 5/0005 206/451
3,426,958 A * 2/1969 Gore ..... B65F 1/1415 383/33
3,785,546 A * 1/1974 Kuster ..... B65D 33/00 383/14
3,974,957 A * 8/1976 Benzon-Petersen ... B65D 31/00 206/466
4,219,573 A * 8/1980 Borek ..... A23L 7/183 426/107

(Continued)

FOREIGN PATENT DOCUMENTS

AU 4540200 A * 10/2000 ..... B65D 75/5855
KR 20170045467 A * 4/2017 ..... B65F 1/14

OTHER PUBLICATIONS

"Belle KR® Mylar Bags for Food Storage with 7.5mil Thickness—Pack of 100 (6"x9") Self-Stand-up Clear Mylar Ziplock Bags with Label Stickers—Resealable Bags for Packaging," accessed at Amazon.com: BelleKR® Mylar Bags for Food Storage with 7.5mil Thickness—Pack of 100 (6"x9") Self-Stand-up Clear Mylar Ziplock Bags with Label Stickers—Rescalable Bags for Packaging Home & Kitchen on May 8, 2023.

(Continued)

*Primary Examiner* — Rakesh Kumar
(74) *Attorney, Agent, or Firm* — Klarquist Sparkman, LLP

(57) ABSTRACT

This disclosure is directed to a storage system for perishable items and an apparatus for dispensing the storage system for perishable items. More specifically, this disclosure is directed to a storage system for perishable items comprising a container having a first end, a second end, and a sealing member at the first end, and a support member secured to the container within a secured region and an unsecured region where the container is not secured to the support member.

19 Claims, 9 Drawing Sheets

(56) References Cited

U.S. PATENT DOCUMENTS 4,586,630 A * 5/1986 Loder ..... B65D 83/0805 221/63
5,737,775 A * 4/1998 Schwartz ..... A41D 27/20 2/243.1
6,109,493 A * 8/2000 Bieri ..... B60R 7/06 312/319.1
6,655,526 B2 12/2003 Urman et al.
7,022,359 B2 * 4/2006 Montserrate Gibernau ..... B65D 81/3461 426/112
7,228,968 B1 * 6/2007 Burgess ..... B65D 75/5838 206/812
7,364,360 B2 * 4/2008 Urman ..... B65D 33/065 383/66
7,854,021 B2 * 12/2010 Compton ..... A41D 27/08 2/243.1
11,884,473 B2 * 1/2024 Gorman ..... B65D 81/3469
2004/0247208 A1 * 12/2004 Krohne ..... B65D 33/2508 383/42
2005/0274780 A1 * 12/2005 Charlton ..... B65D 77/0406 229/110
2008/0193058 A1 * 8/2008 Rothstein ..... B65D 33/2508 383/105
2009/0245698 A1 10/2009 Miller
2011/0086141 A1 4/2011 Strillich et al.
2012/0076444 A1 * 3/2012 Ostergaard ..... B65D 33/01 383/121.1
2014/0346177 A1 * 11/2014 Moncrief ..... A47K 10/46 220/500
2015/0320499 A1 * 11/2015 Ma ..... A61B 50/30 206/363
2016/0015388 A1 * 1/2016 Ren ..... B65F 1/002 156/305
2016/0332804 A1 * 11/2016 Ostergaard ..... B65D 33/20
2024/0375850 A1 * 11/2024 Bruce ..... B65D 83/0835

OTHER PUBLICATIONS

"The Perfect Pizza Pack™—Reusable Pizza Storage Container with 5 Microwavable Serving Trays—BPA-Free Adjustable Pizza Slice Container to Organize & Save Space," accessed at Amazon.com: The Perfect Pizza Pack™—Reusable Pizza Storage Container with 5 Microwavable Serving Trays—BPA-Free Adjustable Pizza Slice Container to Organize & Save Space, Red: Home & Kitchen on May 8, 2023.

* cited by examiner

STORAGE SYSTEM FOR PERISHABLE ITEMS

FIELD

The present disclosure is directed to storage systems for perishable items and, in particular, to storage systems for receiving and storing food items.

BACKGROUND

Currently, storage containers for perishable items have a number of shortcomings. For example, while flexible storage bags for perishable items are convenient, their flexible structures can make it difficult to place perishable items inside. On the other hand, solid plastic containers can be easier to fill, but they take up more room than storage bags in use and prior to use. Therefore, one looking to store perishable items must decide between flimsy flexible bags that can be difficult to use or solid plastic containers that take up unnecessary space.

Furthermore, certain perishable food items, such as slices of pizza, can quickly become sodden, dry, and thus inedible, which only progresses faster if they are not stored into a proper medium that can limit the amount of air they are subjected to. Moreover, irregular shaped food items are often left in their original packaging, such as an original pizza storage box, because of the difficulty in handling a conventional elastic storage bag and because food storage containers may not be accommodating to the shape of the food item, such as the triangle shape of a slice of pizza.

Therefore, there is a need for a food storage system with improved handling while limiting the area the food storage system takes up, both in use and in storage.

SUMMARY

The present disclosure provides for a storage system for perishable items that includes a container that has a support member secured to the container by adhesive.

Certain disclosed embodiments concern a storage system for perishable items comprising a container having a first side wall, a second side wall opposing the first side wall, a first end, a second end, and a sealing member at the first end, the container having a first length that extends along a longitudinal axis of the storage system from the first end to the second end and a first width that is perpendicular to the longitudinal axis, and a support member. A secured region is provided where the second side wall of the container is secured to the support member (such as by an adhesive) and can have a second length along the longitudinal axis, and an unsecured region where the support member is not secured to the second side wall can extend along the longitudinal axis from the secured region to the first end of the container and have a third length along the longitudinal axis. The unsecured region can extend the entire first width of the container along the third length.

In some embodiments, a ratio of the second length to the first length can be from 10:1 to 4:1, and a ratio of the third length to the first length can be 1:10 to 1:4. The container can be moveable between a closed configuration in which the sealing member is closed and a second configuration in which the sealing member is open. The first end of the container can define an orifice between the first side wall and the second side wall.

In some embodiments, the adhesive can be an adhesive layer having a forward end and a rear end, the forward end being closer to the sealing member, and wherein the adhesive layer has a forward width at the rear end and a rear width at the rear end, and the rear width is greater than the forward width. In other embodiments, the support member can include a support member comprising an insert and a sleeve configured to receive the insert, wherein the second side wall of the container is secured to an upper surface of the sleeve. In other particular disclosed embodiments, the storage systems for perishable items may further comprise a first gusset at a first area between the first side wall and second side wall of the container extending longitudinally, and a second gusset at a second area between the first side wall and the second side wall of the container extending longitudinally, and the first area and the second area being on opposing sides of the container.

A dispensing system also is disclosed. The dispensing system can comprise a plurality of storage systems for perishable item disclosed herein, a receptacle having an internal chamber, and the receptacle further comprising an opening at a bottom portion of the receptacle, the opening being sized to allow one of the plurality of storage containers to be removed from the receptacle.

The foregoing and other objects, features, and advantages of the invention will become more apparent from the following detailed description, which proceeds with reference to the accompanying figures.

DETAILED DESCRIPTION

I. Overview of Terms

Figure 1:
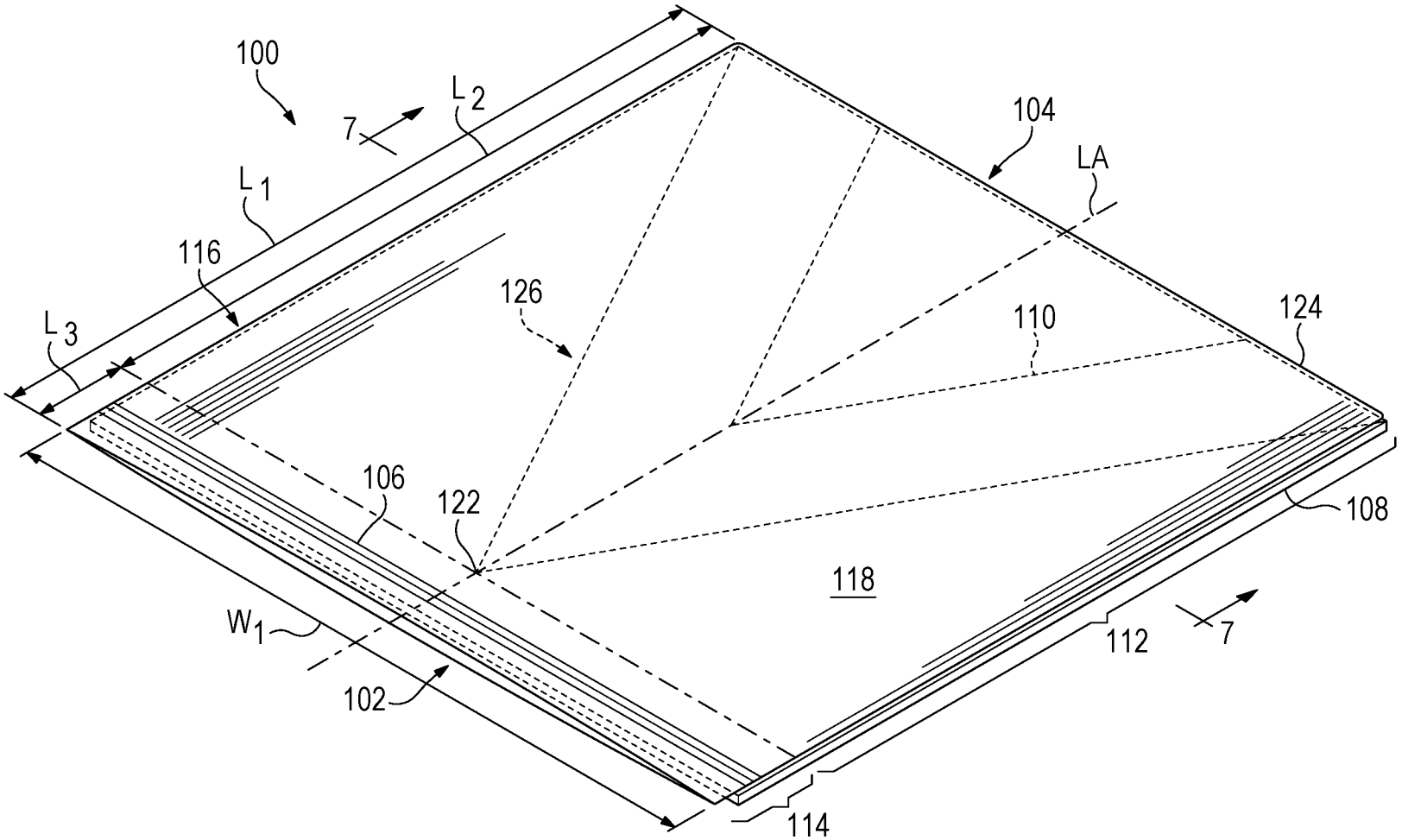
FIG. 1 is a perspective side view of an embodiment of the storage system for perishable items depicting the sealing member in a closed configuration.

For purposes of this description, certain aspects, advantages, and novel features of the embodiments of this disclosure are described herein. The disclosed systems and methods should not be construed as being limiting in any way. Instead, the present disclosure is directed toward all novel and nonobvious features and aspects of the various disclosed embodiments, alone and in various combinations and subcombinations with one another. The systems and methods are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

All features described herein are independent of one another and, except where structurally impossible, can be used in combination with any other feature described herein.

As used in this application and in the claims, the singular forms "a," "an," and "the" include the plural forms unless the context clearly dictates otherwise. Additionally, the term "includes" means "comprises." Further, the term "coupled" generally means physically, mechanically, chemically, magnetically, and/or electrically coupled or linked and does not exclude the presence of intermediate elements between the coupled or associated items absent specific contrary language.

In the description, certain terms may be used such as "up," "down," "upper," "lower," "horizontal," "vertical," "left," "right," and the like. These terms are used, where applicable, to provide some clarity of description when dealing with relative relationships. However, these terms are not intended to imply absolute relationships, positions, and/or orientations. For example, with respect to an object, an "upper" surface can become a "lower" surface simply by turning the object over. Nevertheless, it is still the same object.

Similar components in different embodiments are described in the specification and illustrated in the figures with similar reference numbers for improved understanding and readability. However, it should be understood that this numbering convention is merely for convenience and is not intended to limit and/or exclude any claim scope.

II. System

The present disclosure provides for an improvement in storing perishable items, such as left-over food from a meal or pre-prepared food.

FIG. 1 illustrates an embodiment of a storage system 100 in a closed configuration. The storage system comprises a container 116 having a first side wall, 118, a second side wall 120, a first length $L_1$ that extends along a longitudinal axis LA of the storage system 100 from the first end 102 to the second end 104, a sealing member 106 at the first end 102, and a first width $W_1$ that is perpendicular to the longitudinal axis LA. A support member 108 is secured to an outer surface of the second side wall 120 of the container with an adhesive 110.

As depicted by FIG. 1, the storage system 100 may comprise a secured region 112, extending along the longitudinal axis LA, where the support member 108 can be secured. The secured region 112 has a second length $L_2$ along the longitudinal axis LA. Furthermore, the support member 108 also comprises an unsecured region 114, extending along the longitudinal axis LA, where the container 116 is not secured to the support member 108. The unsecured region 114 extends along the longitudinal axis from the secured region 112 to the first end 102 and has a third length along $L_3$ the longitudinal axis.

In some embodiments, the storage system 100 can have a first length $L_1$ that extends along a longitudinal axis LA of the storage system from the first end 102 to second end 104 ranging from 8 inches to 20 inches, such as from 9 inches to 19 inches, from 10 inches to 18 inches, from 11 inches to 17 inches, from 12 inches to 16 inches, from 13 inches to 15 inches, or from 14 inches to 15 inches. In particular disclosed embodiments, the secured region can have a second length $L_2$ ranging from 7 inches to 15 inches, such as from 8 inches to 14 inches, 9 inches to 13 inches, from 10 inches to 12 inches, from 10 to 11 inches. In some embodiments, the unsecured region can have a third length $L_3$ ranging from greater than 0 inch to 5 inches, such as from 1 inch to 4 inches, or from 2 inches to 3 inches. In particular disclosed embodiments, the unsecured region extends the entire first width $W_1$ of the container along the third length. The first width $W_1$ can have similar sizes to the first length. For example, the first width $W_1$ can range from 8 inches to 20 inches, such as from 9 inches to 19 inches, from 10 inches to 18 inches, from 11 inches to 17 inches, from 12 inches to 16 inches, from 13 inches to 15 inches, or from 14 inches to 15 inches.

In particular disclosed embodiments, the container can have a length ratio of the length of the unsecured region ($L_3$) to the first length ($L_1$) ranging from 1:10 to 1:4.

In particular disclosed embodiments, the storage system the length of the secured region ($L_2$) can be 75% to 90% of the first length ($L_1$). In particular disclosed embodiments, the length of the unsecured region ($L_3$) can be 10% to 25% of the first length ($L_1$).

Exemplary lengths of different embodiments of the food storage systems described herein are provided below in Table 1, which lists exemplary first lengths, second lengths, and third lengths.

TABLE 1

| First Length (inches) | Second Length (inches) | Third Length (inches) |
|---|---|---|
| 20 | 17 | 3 |
| 20 | 18 | 2 |
| 20 | 19 | 1 |
| 19 | 16 | 3 |
| 19 | 17 | 2 |
| 19 | 18 | 1 |
| 18 | 15 | 3 |
| 18 | 16 | 2 |

TABLE 1-continued

| First Length (inches) | Second Length (inches) | Third Length (inches) |
|---|---|---|
| 18 | 17 | 1 |
| 17 | 14 | 3 |
| 17 | 15 | 2 |
| 17 | 16 | 1 |
| 16 | 13 | 3 |
| 16 | 14 | 2 |
| 16 | 15 | 1 |
| 15 | 12 | 3 |
| 15 | 13 | 2 |
| 15 | 14 | 1 |
| 14 | 11 | 3 |
| 14 | 12 | 2 |
| 14 | 13 | 1 |
| 13 | 10 | 3 |
| 13 | 11 | 2 |
| 13 | 12 | 1 |
| 12 | 9 | 3 |
| 12 | 10 | 2 |
| 12 | 11 | 1 |
| 11 | 8 | 3 |
| 11 | 9 | 2 |
| 11 | 10 | 1 |
| 10 | 8 | 2 |
| 10 | 9 | 1 |
| 9 | 7 | 2 |
| 9 | 8 | 1 |
| 8 | 6 | 2 |
| 8 | 7 | 1 |

Figure 2:
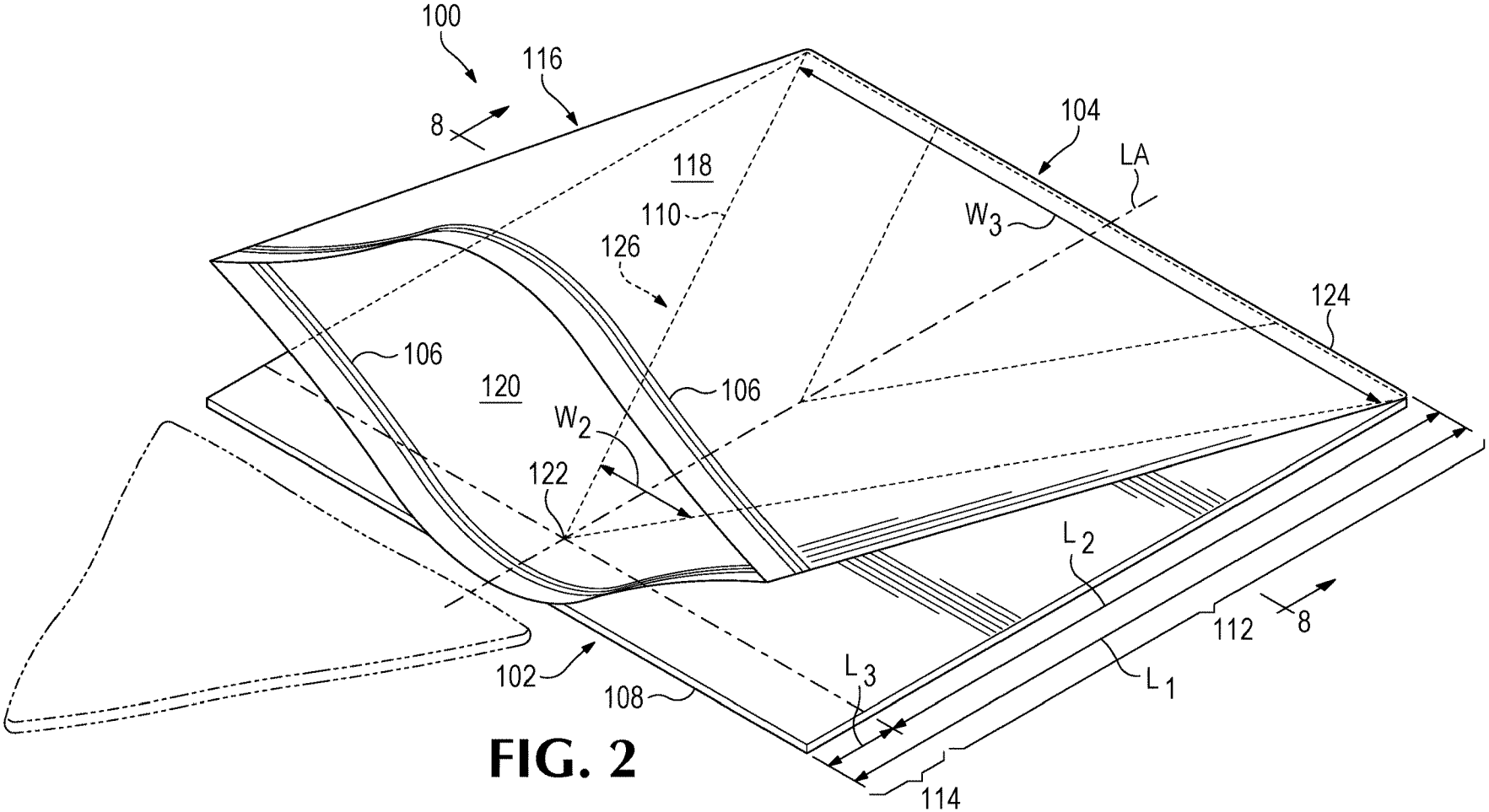
FIG. 2 is a perspective side view of an embodiment of the storage system for perishable items depicting the sealing member in an open configuration.

FIG. 2 depicts the storage system 100 of FIG. 1 with container 116 in an open configuration. The support member 108 is secured to an external surface (relative to an interior chamber of the container 116) of the second side wall 120 of the container 116 with an adhesive 110 that extends the length of the secured region 112. As shown in FIG. 2, the secured region 112 has a second length $L_2$ along the longitudinal axis LA.

An unsecured region 114, where the second side wall 120 is not secured to the support member 108, extends along the longitudinal axis LA from an end of the secured region 112 to the first end 102 of the container 116, and has a third length $L_3$ along the longitudinal axis LA. As shown in FIG. 2, the unsecured region 114 extends the entire first width $W_1$ of the container 116 along the third length $L_3$. In contrast, the secured region 112 of FIG. 2 is secured along the entire length of the secured region, but not secured along the entire width of the secured region. As discussed in more detail below, an amount and/or width of the adhesive can vary along the length of the secured region.

In some embodiments, the container is a flexible container to facilitate the handling of the container when the sealing member is open. Moreover, the container is less rigid than the support member. In some embodiments, the container comprises a polymeric material made from a polymer and/or polymers to provide for a flexible container. For example, the flexible container can be polyethylene, polypropylene, polyesters, and their laminates, high density polyethylene, PVC, nylon, and the like. In an exemplary embodiment, the container comprises a low-density polyethylene (LDPE). In another exemplary embodiment, the container comprises a high-density polyethylene (HDPE).

In other particular disclosed embodiments, the container is made of a biodegradable and/or compostable material. For example, the container can be made of cellulose obtained from wood pulp or cotton.

In order to extend the shelf life and quality of the food, the polymeric material can be a breathable polymeric material. For example, micro perforations can be made on the polymeric container. The micro perforations control the amount of oxygen entering the bag and the expulsion of carbon dioxide out of the container, and thus extend the shelf life and freshness of the food.

In some embodiments, the container of the system for perishable items can be a food storage container. For example, the food storage container may comprise a bag-type container having a first side wall, a second side wall opposing the first side wall, a first end, a second end, and a sealing member at the first end. The bag-type container can have a first length that extends along a longitudinal axis of the storage system from the first end to the second end and a first width that is perpendicular to the longitudinal axis. A rigid support member can be secured to the second side wall of the container with an adhesive at a secured region having a second length along the longitudinal axis. An unsecured region can be provided where the container is not secured to the rigid support member, such that the unsecured region extends along the longitudinal axis from the secured region to the first end of the container and has a third length along the longitudinal axis. Furthermore, the unsecured region can extend the entire first width of the bag-type container along the third length. The bag-type container can be moveable between a closed configuration in which the sealing member is closed and a second configuration in which the sealing member is open and the first end of the container defines an orifice between the first side wall and the second side wall.

As used herein, the term "adhesive" means any device, material, or object attaching and/or holding two or more objects together. For example, the adhesive securing the support member to the container can be an adhesive layer that is capable of holding the two structures together in a functional manner by a surface attachment that resists separation.

As used herein, the term "rigid" means a level of stiffness commonly associated with materials used to support food items without significant bending and/or failure. In some embodiments, a rigid material can have a modulus of elasticity greater than 0.5 GPa (gigapascal), greater than 1.25 GPa, or greater than 2.0 GPa. In some embodiments, the rigid material can also have a modulus of elasticity that is less than 12 GPa, less than 8 GPa, or less than 6 GPa (e.g., between 0.5-12 GPa, between 1.25-8 GPa, between 2.0-6 GPa, etc.).

Examples of rigid material can include, low-density paperboard which can have a modulus of elasticity that ranges from 0.5 GPa to 2.5 GPa, cardboard which can have a modulus of elasticity that ranges from 2 GPa to 12 GPa, and ceramic materials (e.g., alumina, silicon carbide, zirconia, boron carbide, titanium diboride) which can have a modulus of elasticity that ranges from 350 GPa to 600 GPa.

In particular disclosed embodiments, the adhesive and/or adhesive layer can be non-continuous such that the adhesive layer is formed by a plurality of discontinuous and/or spaced-apart adhesive portions in the secured region. For example, a portion of the adhesive layer can have a forward end and a rear portion placed discontinuously onto the support member to form a discontinuous adhesive layer.

In some embodiments, the adhesive layer can be continuous such that it continuously extends from a forward end to a rear end of the support member. FIG. 2 illustrates a continuous adhesive layer having a forward end 122 and a rear end 124 such that the forward end 122 is closer to the sealing member 106, and the adhesive layer 110 has a forward width $W_2$ at the forward end 122 and a rear width $W_3$ at the rear end 124 as shown by FIG. 2. The width of the adhesive layer can vary along the length of the secured region as shown in FIG. 2, such as by increasing in width from the forward end 122 to the rear end 124.

Figure 3:
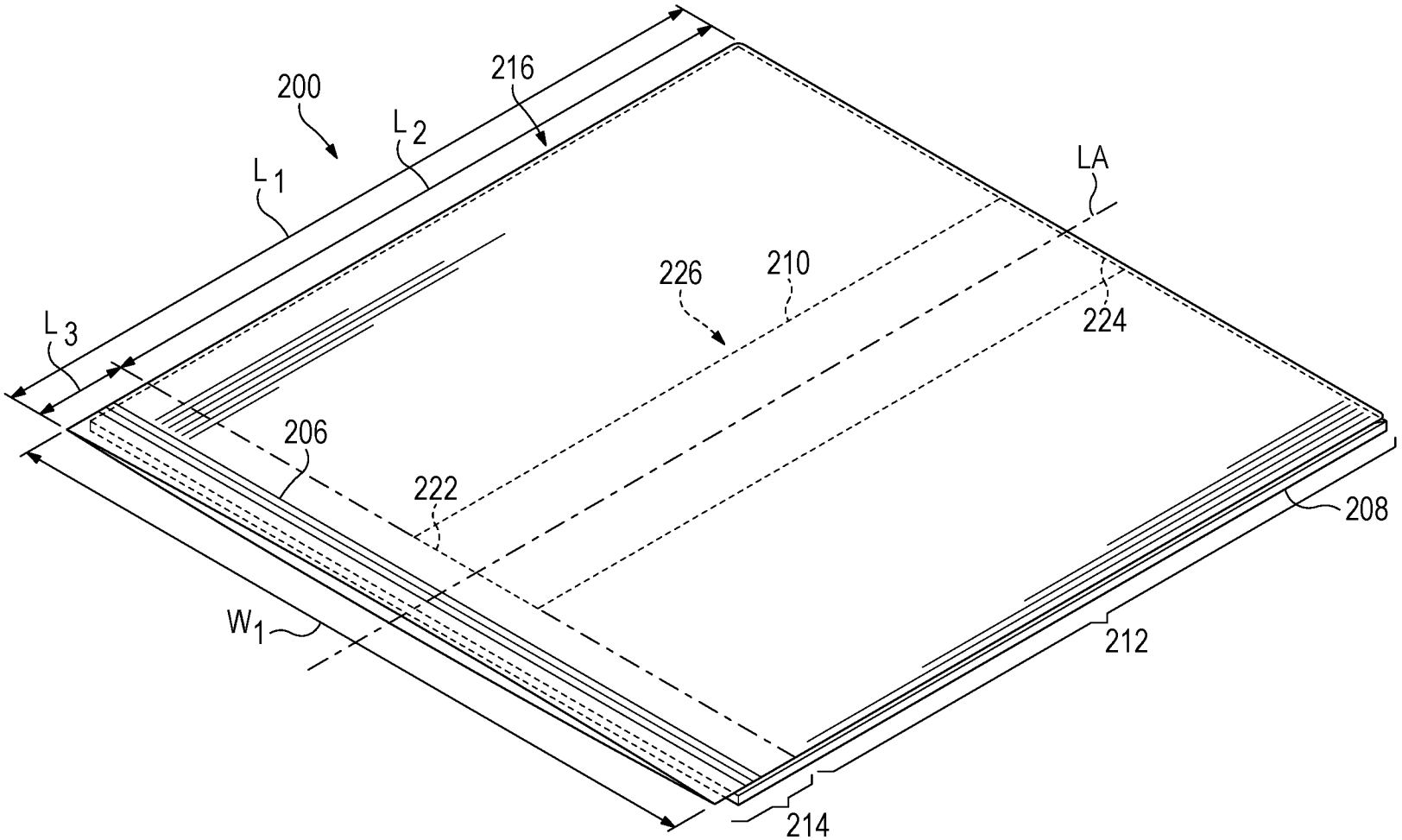
FIG. 3 is a perspective side view of an embodiment of the storage system for perishable items depicting an exemplary adhesive layer.

In particular disclosed embodiments, the adhesive may comprise a continuous adhesive layer forming a rectangular shape. FIG. 3 illustrates an embodiment of the storage system for perishable items 200 in a closed configuration comprising a container having a first length $L_1$ that extends along a longitudinal axis LA of the storage system for perishable items 200 from the first end 202 to the second end 204, and a sealing member 206 at the first end 202 and a first width $W_1$ that is perpendicular to the longitudinal axis LA. A support member 208 can be secured to the second side wall of the container with an adhesive 210. As depicted by FIG. 3, the system for perishable items 200 may comprise a secured region 212 where the support member 208 is secured to the container. The secured region 212 has a second length $L_2$ along the longitudinal axis LA. Furthermore, the container 216 also comprises an unsecured region 214 where the container 216 is not secured to the support member 208. The unsecured region 214 can extend along the longitudinal axis LA from the secured region 212 to the first end 202 and have a third length along $L_3$ the longitudinal axis LA. Furthermore, an adhesive layer (e.g., a continuous adhesive layer) can have a forward end 222 and a rear end 224, forming a rectangular-shaped adhesive layer 226.

Figure 4:
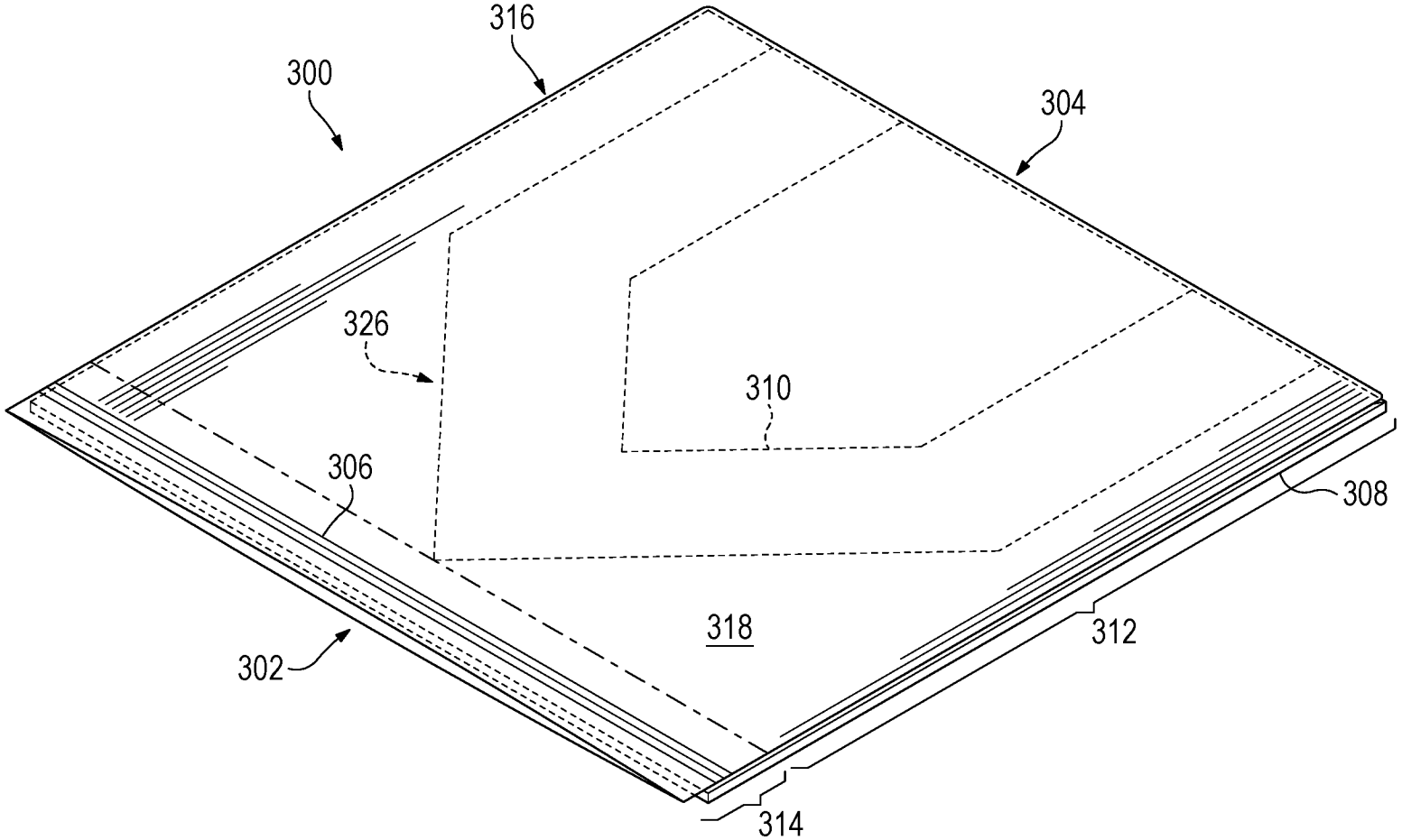
FIG. 4 is a perspective side view of an embodiment of the storage system for perishable items depicting another exemplary adhesive layer.

As discussed above, in some embodiments, the layer can have a rear width $W_2$ that is greater than the forward width $W_3$. For example, as shown in FIG. 2, the adhesive layer tapers from the rear end (e.g., a wider adhesive application) to the forward end (e.g., a narrower adhesive application) to form a V-shaped layer 126 that has a narrow end of adhesive that diverges into two increasingly spaced-apart legs of adhesive. In another exemplary embodiment, as illustrated by FIG. 4, a storage system 300 comprises a secured region 312 of the support member 308 with an adhesive 310 that forms an adhesive layer that form another V-shaped layer 326 that has a narrow end of adhesive that diverges into two spaced-apart legs of adhesive. The V-shaped layer 326 defines an open, irregular pentagon shape, similar to a "home plate" in baseball.

In particular disclosed embodiments, the adhesive can be an adhesive layer comprising any suitable hot melt, water, or solvent borne adhesive that can be applied to the surface of the member support. Accordingly, the adhesive can be a holt melt adhesive, pressure-sensitive adhesive, reactive adhesives, and/or the like. The adhesive layer may comprise for example, but are not limited to polylactic (PLA), 3-hydroxy butyric acid and 3-hydroxy pentanoic acid (3-hydroxy valeric acid) (PHBV), polyvinyl alcohol (PVOH), biobased ethylene vinyl acetate (EVA), polyurethane (PU), vinyl acetate polymers (PVA) polyethylene oxide (PEO), polyhydroxyalkanoate (PHA), polycaprolactone (PCL), polyethylene material, e.g. as a low-density polyethylene (LDPE), a bio coating, a printed lacquer, a varnish lacquer, water-based varnish, 1,4 succinic acid, fumaric acid, malic acid, 2,5 furan dicarboxylic acid, 3 hydroxy propionic acid, aspartic acid, glucaric acid, glutamic acid, itaconic acid, levulinic acid, 3-hydroxybutyrolactone, glycerol, sorbitol, xylitol/arabinitol or tricarboxylic acid.

In some embodiments, the adhesive may comprise ultrasonic bonding, heat sealing, thermal bonding, stitching, double sided tape, staples, and the like. Alternatively, the adhesive holds the container to the support member such that the container is removable. For example, the adhesive can be a hook and loop fastener (e.g., Velcro®), one or more magnets, pins, and the like.

Figure 5A:
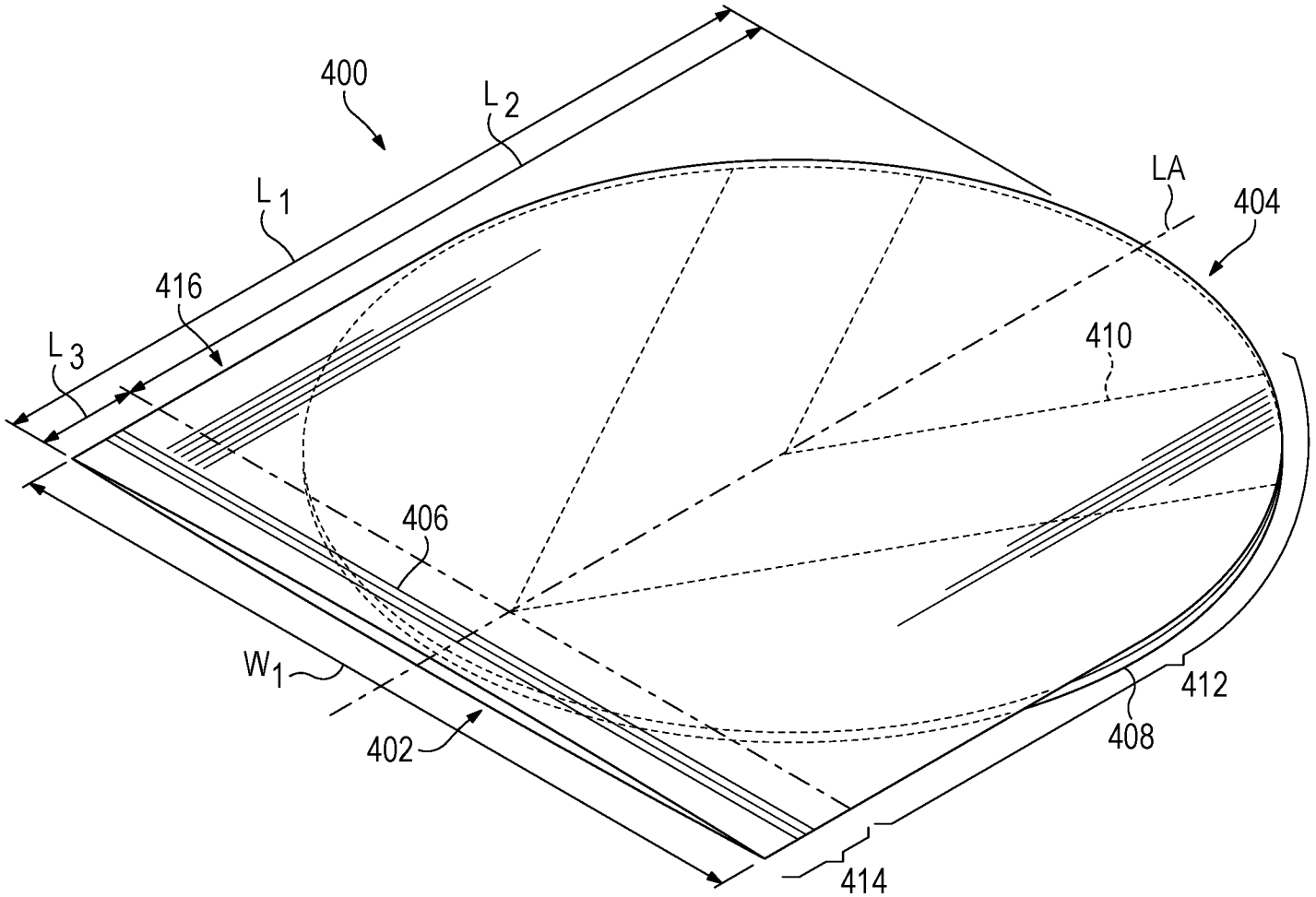
FIG. 5A is a perspective side view of an embodiment of the storage system for perishable items depicting an exemplary support member and sealing member.

In some embodiments, the support member comprises a flat surface (i.e., a height of the support member varies by less than 5%). For example, the support member may comprise a rectangular shape as shown by FIGS. 1-4. Alternatively, the support member may have one or more rounded edges. For example, FIG. 5A depicts a storage system for perishable items 400 comprising a container 416 having a first end 402, a second end 404 and a sealing member 406. Moreover, the container 416 has first length $L_1$ that extends along a longitudinal axis LA of the storage system for perishable items 400 from the first end 402 to the second end 404 and a first width $W_1$ that is perpendicular to the longitudinal axis LA. In this example, the support member 408 comprises a circular shape, which is secured to the container 416 with an adhesive 410 at a secured region 412 having a second length $L_2$ along the longitudinal axis LA. An unsecured region 414 extends along the longitudinal axis from an end of the secured region 412 to the first end 402 of the container 416, and has a third length $L_3$ along the longitudinal axis. As in other embodiments, the unsecured region 414 extends the entire first width $W_1$ of the container along the third length $L_3$.

Figure 5B:
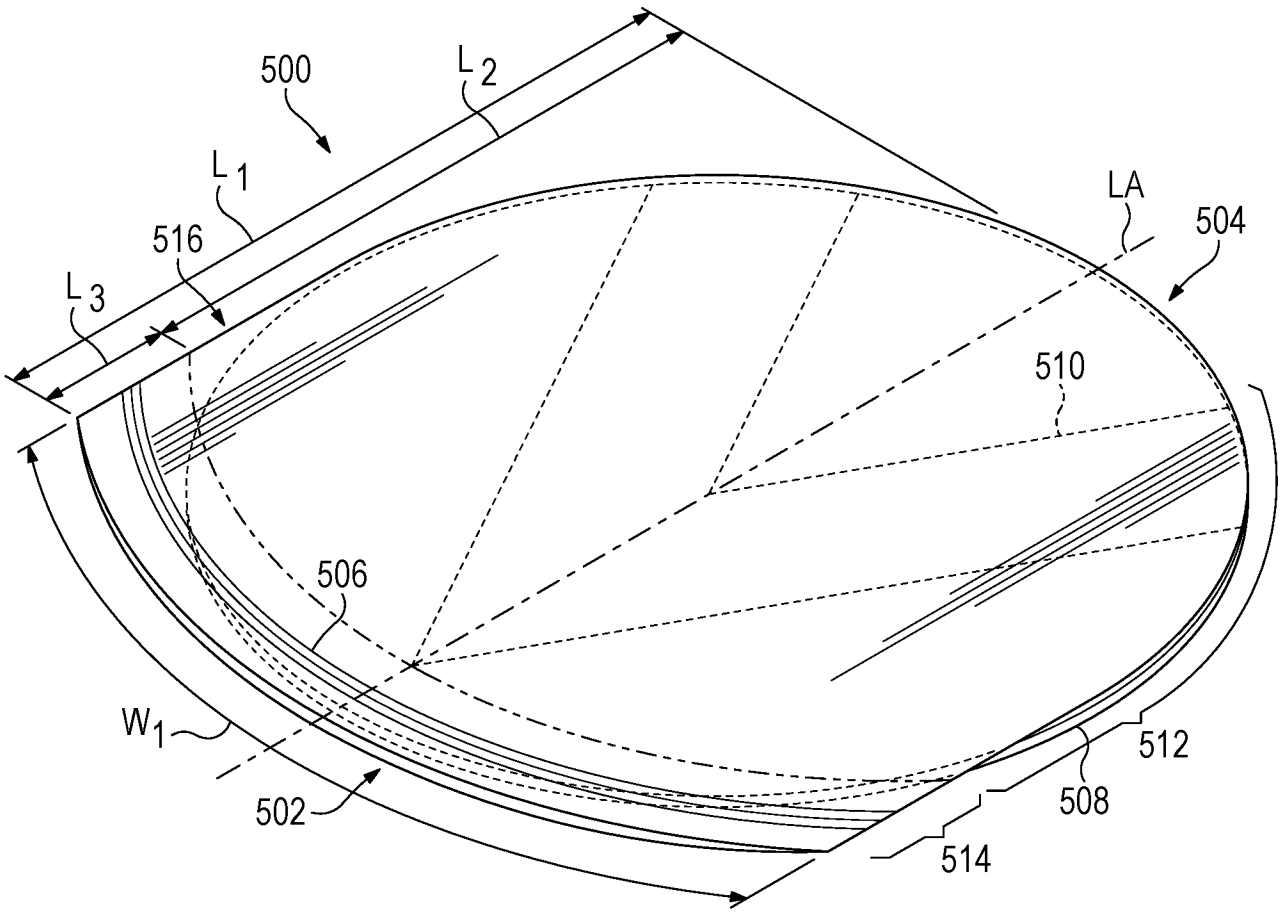
FIG. 5B is a perspective side view of an embodiment of the storage system for perishable items depicting an exemplary support member and sealing member.

FIG. 5B illustrates a storage system 500, similar to that of FIG. 5A, but with a sealing member 506 at the first end 502 having one or more rounded edges. When the sealing member 506 is open, the first end 502 of the container defines an orifice between the first side wall and the second side wall. The container 516 has a first length $L_1$ that extends along a longitudinal axis of the storage system for perishable items 500 from the first end 502 to the second end 504 and a first width $W_1$ that is perpendicular to the longitudinal axis. The support member is secured to the container 516 with an adhesive 510 at a secured region 512 having a second length $L_2$ along the longitudinal axis. An unsecured region 514 extends along the longitudinal axis from an end of the secured region 512 to the first end 502 of the container 516, and has a third length $L_3$ along the longitudinal axis. The unsecured region 514 extends the entire first width $W_1$ of the container along the third length $L_3$.

In particular disclosed embodiments, the support member can be a rigid support member. In some embodiments, the rigid support member can be made of ceramic, glass, wood, or metal. For example, the ceramic material can be bone China, porcelain, earthenware, stoneware, and the like. Alternatively, the rigid support member can be made of paperboard, a rigid polymeric material, combinations thereof. For example, the rigid support member can be made of carboard, PLA, cornstarch, bagasse, wood, fiber, bamboo fiber, palm leave, and the like.

Figure 6:
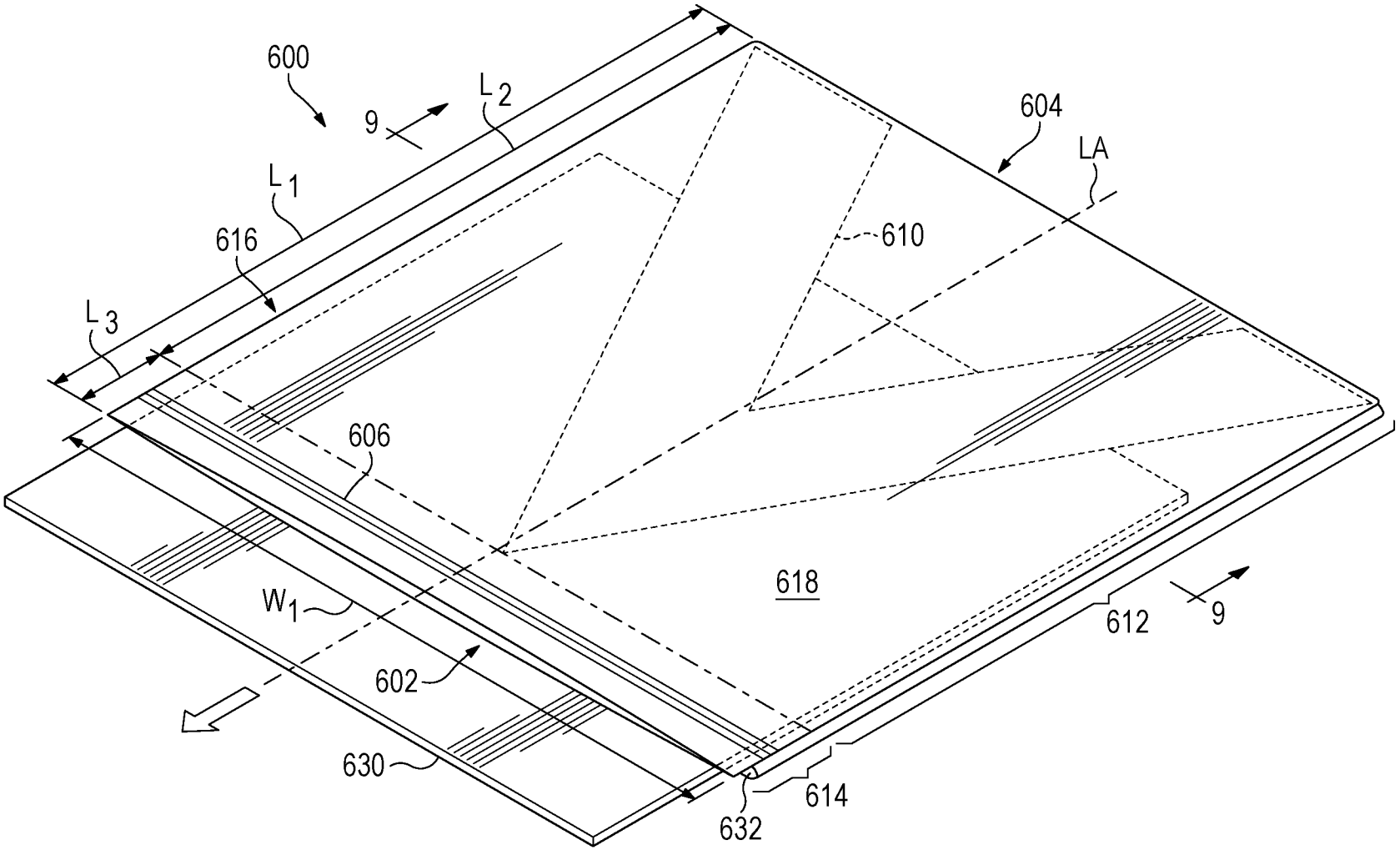
FIG. 6 is a perspective side view of an embodiment of the storage system for perishable items depicting a container having a first cavity and second cavity, wherein a perishable item is disposed into the first cavity and a support member is disposed into the second cavity.
Figure 9:
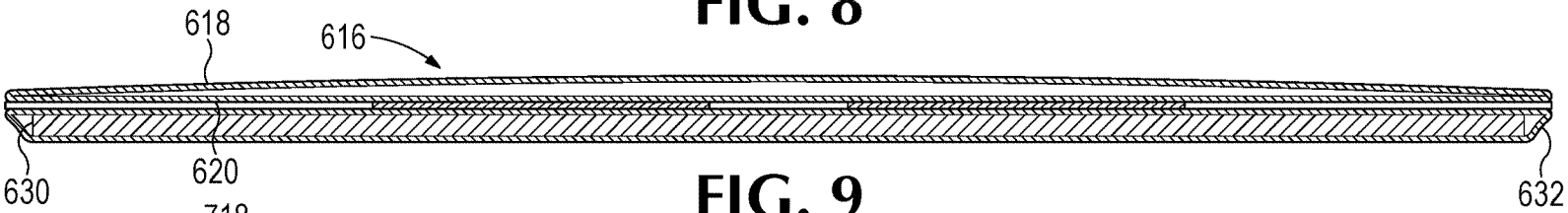
FIG. 9 is a cross-sectional view of the storage system for perishable items shown in FIG. 6.

In some embodiments, the storage system for perishable items may further comprise an insert and a sleeve configured to receive the insert. For example, as illustrated by FIGS. 6 and 9, the storage system 600 may comprise a container 616 having a first side wall 618, a second side wall 620 opposing the first side wall, a first end 602, a second end 604, and a sealing member 606 at the first end 602. Accordingly, the support member 608 can have an upper surface secured to the external surface of the second side wall 620 with an adhesive 610 and comprises an insert 630 and sleeve 632 configured to receive the insert 630. The support member 608 is secured to the second side wall 620 of the container 616 at a secured region 612 having a second length $L_2$ along the longitudinal axis. An unsecured region 614 extends along the longitudinal axis from an end of the secured region 612 to the first end 602 of the container 616 and has a third length $L_3$ along the longitudinal axis. The unsecured region 614 can extend the entire first width $W_1$ of the container 616 along the third length $L_3$.

Figure 7:
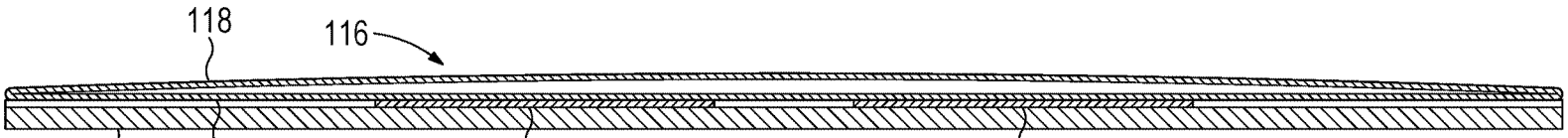
FIG. 7 is a cross-sectional view of the storage system for perishable items shown in FIG. 1.
Figure 8:
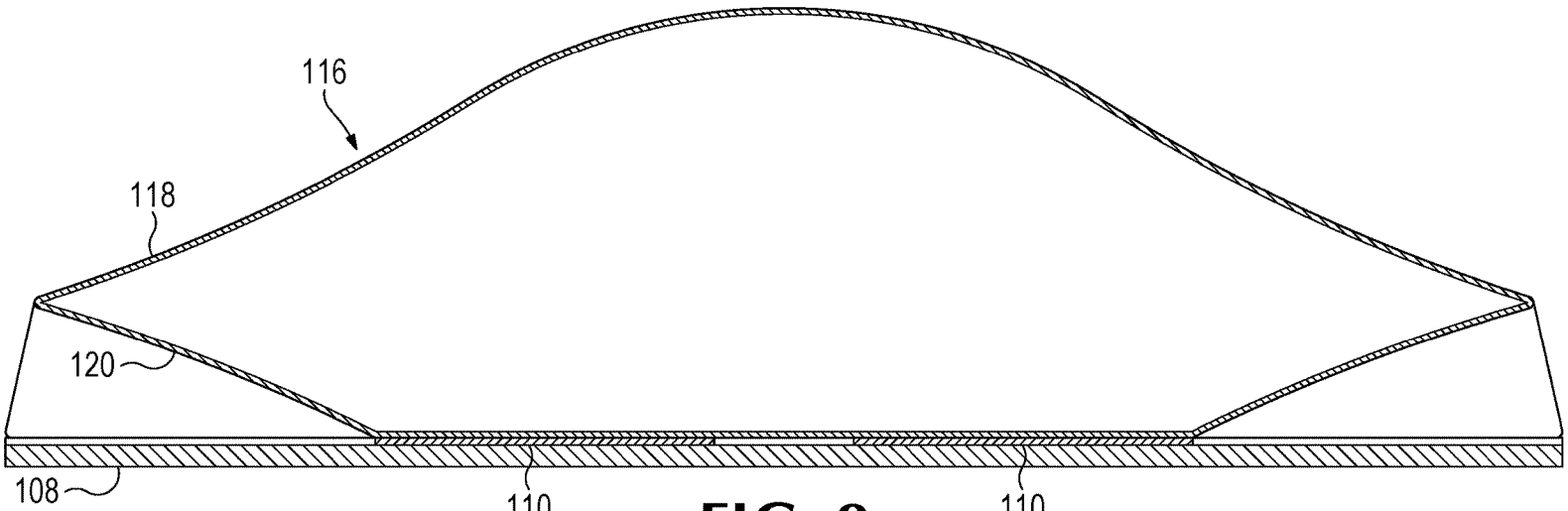
FIG. 8 is a cross-sectional view of the storage system for perishable items shown in FIG. 2.

FIGS. 7 and 8 are cross-sectional views of FIGS. 1 and 2, respectively, depict the container in the closed configuration (FIG. 7) and open configuration (FIG. 8). As shown in FIGS. 7 and 8 and discussed above, the container 116 has a first side wall 118 and a second side wall 120 opposing the first side wall 118. An external surface of the second side wall 120 is attached to the support member 108.

FIG. 9 is a cross-sectional view of FIG. 6, showing the container 616 in the closed configuration with a first side wall 618, a second side wall 620 opposing the first side wall 618, and a support member 608 having an insert 630 within a sleeve 632. The support member 608 is attached to the second wall 620 of the container 616 at an upper surface of the sleeve 632 of the support member.

Figure 10:
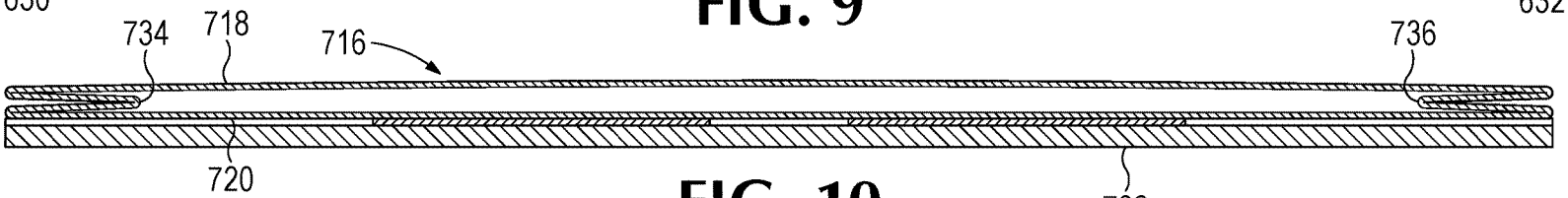
FIG. 10 is a cross-sectional view of an embodiment of the storage system for perishable items depicting a container having a first gusset and a second gusset.

In some embodiments, it may be desirable to further expand the container to receive additional items inside the container. If desired, the container of the system may comprise one or more gussets as shown in FIG. 10. For example, FIG. 10 depicts a container 716 having a first side wall 718, a second side wall 720 opposing the first side wall 718, a first gusset 734 at a first area between the first side wall 718 and second side wall 720 of the container 716 extending longitudinally. A second gusset 736 can be provided opposite the first gusset 734 at a second area between the first side wall 718 and the second side wall 720 of the container 716 extending longitudinally. As in other embodiments disclosed herein, the support member 708 can be attached to the second side wall 720 via an adhesive.

Figure 11:
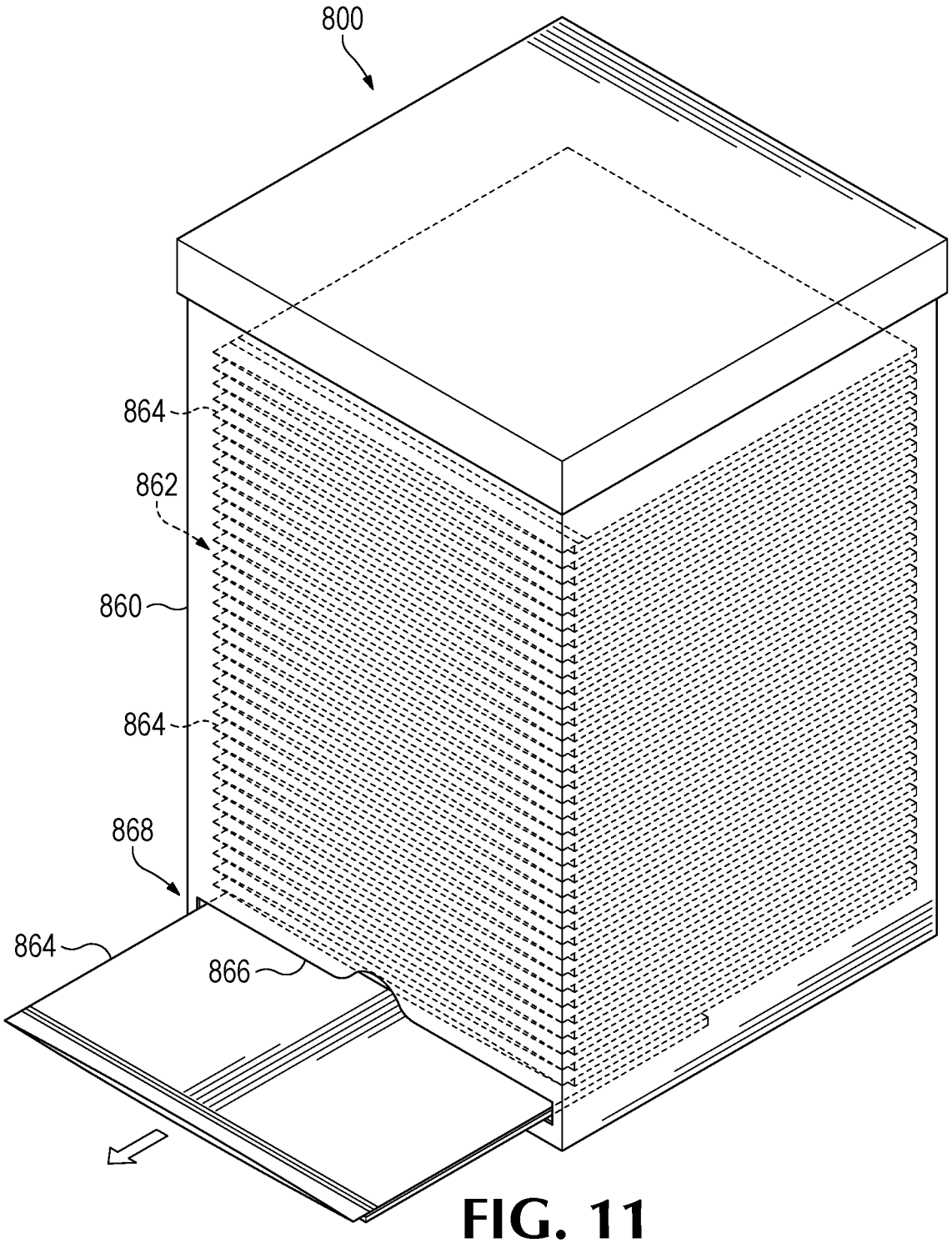
FIG. 11 is a perspective view of an embodiment of an apparatus for dispensing the storage system for perishable items.

Also disclosed herein is a dispensing system comprising a receptacle for transporting and storing a plurality of storage containers disclosed herein. FIG. 11 illustrates an exemplary embodiment of the dispensing system 800 comprising a receptacle 860 having an internal chamber 862, and a plurality of storage containers 864 (e.g., the storage containers 100, 200, 300, 400, 500, 600, 700, etc.) for perishable items disclosed herein received in the internal chamber 862 of the receptacle 860. The receptacle 860 comprising an opening 866 at a bottom portion 868 of the receptacle 860, the opening being sized to allow one of the plurality of storage containers for perishable items disclosed herein to be removed from the receptacle 860.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A storage system for perishable items, comprising:

a container having a first side wall, a second side wall opposing the first side wall, a first end, a second end, and a sealing member at or adjacent the first end, the container having a first length that extends along a longitudinal axis of the storage system from the first end to the second end and a first width that is perpendicular to the longitudinal axis, wherein the first side wall and second side wall are joined at a first side edge, a second side edge, and a rear edge; and a support member secured to the second side wall of the container by an adhesive, the support member extending between a forward end of the second side wall and a rear end of the second side wall;

wherein the container is moveable between a closed configuration in which the sealing member is closed and a second configuration in which the sealing member is open and the first end of the container defines an orifice between the first side wall and the second side wall, wherein the adhesive is provided at the forward end and the rear end of the second side wall, the forward end of the second side wall being adjacent to the sealing member, wherein, at the forward end of the second side wall, the adhesive is spaced inward from the first side edge and the second side edge such that the second side wall is secured to the support member at only a central area of the forward end, and wherein, at the rear end of the second side wall, the adhesive is disposed adjacent the first side edge and adjacent the second side edge.

2. The storage system of claim 1, wherein the support member has a greater rigidity than the container.

3. The storage system of claim 1, wherein the support member is a rigid support member.

4. The storage system of claim 1, wherein the container comprises at least one polymeric material.

5. The storage system of claim 4, wherein the at least one polymeric material is polyethylene or polypropylene.

6. The storage system of claim 1, wherein the support member has a rectangular shape.

7. The storage system of claim 1, wherein the support member has one or more rounded edges.

8. The storage system of claim 7, wherein the support member has a circular shape.

9. The storage system of claim 1, wherein the adhesive is an adhesive layer that is continuous or discontinuous.

10. The storage system of claim 9, wherein the adhesive layer tapers from the rear end to the forward end.

11. The storage system of claim 9, wherein the adhesive layer forms a V-shape.

12. The storage system of claim 9, wherein the adhesive layer forms a rectangular shape.

13. The storage system of claim 9, wherein the adhesive layer forms an irregular pentagon-shape.

14. The storage system of claim 1, wherein the sealing member comprises two opposing laterally extending cooperating rib and groove profiles.

15. The storage system of claim 14, wherein the sealing member comprises a slider that is slidably coupled to the two opposing laterally extending rib and groove profiles.

16. The system of claim 1, wherein the container further comprises:

a first gusset at a first area between the first side wall and second side wall of the container extending longitudinally; and a second gusset at a second area between the first side wall and the second side wall of the container extending longitudinally, wherein the first area and the second area are on opposing sides of the container.

17. A storage system for perishable items, comprising:

a container having a first side wall, a second side wall opposing the first side wall, a first end, a second end, and a sealing member at or adjacent the first end, the container having a first length that extends along a longitudinal axis of the storage system from the first end to the second end and a first width that is perpendicular to the longitudinal axis;

a support member;

a secured region where the second side wall is secured to the support member, the secured region having a second length along the longitudinal axis; and an unsecured region where the second side wall is not secured to the support member, the unsecured region extending along the longitudinal axis from the secured region to the first end of the container and having a third length along the longitudinal axis, wherein a ratio of the third length to the first length is 1:10 to 1:4; and wherein the container is moveable between a closed configuration in which the sealing member is closed and a second configuration in which the sealing member is open and the first end of the container defines an orifice between the first side wall and the second side wall, wherein the support member comprises an insert and a sleeve configured to receive the insert, wherein the second side wall of the container is secured to an upper surface of the sleeve.

18. A food storage container, comprising:

a bag-type container having a first side wall, a second side wall opposing the first side wall, a first end, a second end, and a sealing member adjacent the first end, the bag-type container having a first length that extends along a longitudinal axis of the bag-type container from the first end to the second end and a first width that is perpendicular to the longitudinal axis, wherein the first side wall and second side wall are joined at a first side edge, a second side edge, and a rear edge;

a rigid support member;

a secured region where the second side wall is secured to the rigid support member by an adhesive, the secured region having a second length along the longitudinal axis; and an unsecured region where the second side wall is not secured to the rigid support member, the unsecured region extending along the longitudinal axis from the secured region to the first end of the bag-type container and having a third length along the longitudinal axis, wherein the second length, which is the length of the secured region where the second side wall is secured to the rigid support member, is at least 75% of the first length, which is the length of the bag-type container along the longitudinal axis, wherein the bag-type container is moveable between a closed configuration in which the sealing member is closed and a second configuration in which the sealing member is open and the first end of the bag-type container defines an orifice between the first side wall and the second side wall, wherein the second side wall is secured to the support member by an adhesive, wherein the adhesive is provided at a forward end and a rear end of the secured region, the forward end being adjacent to the sealing member, wherein, at the forward end of the second side wall, the adhesive is spaced inward from the first side edge and the second side edge such that the second side wall is secured to the support member at only a central area of the forward end, and wherein, at the rear end of the second side wall, the adhesive is disposed adjacent the first side edge and adjacent the second side edge.

19. The food storage container of claim 18, wherein the adhesive is an adhesive layer that is continuous or discontinuous.

* * * * *